US007323647B1

(12) United States Patent
Smith et al.

(10) Patent No.: US 7,323,647 B1
(45) Date of Patent: Jan. 29, 2008

(54) MODULAR DEVICE HAVING SEPARATE CONNECTION AND PLUG-ACTUATED TESTING COMPARTMENTS

(75) Inventors: Thomas J. Smith, Bay Shore, NY (US); Peter A. Arcati, West Babylon, NY (US)

(73) Assignee: TII Network Technologies, Inc., Copiague, NY (US)

( * ) Notice: Subject to any disclaimer, the term of this patent is extended or adjusted under 35 U.S.C. 154(b) by 94 days.

(21) Appl. No.: 10/882,895

(22) Filed: Jul. 1, 2004

(51) Int. Cl.
*H01H 27/00* (2006.01)

(52) U.S. Cl. ..... 200/43.04; 200/51 R; 439/676; 379/399

(58) Field of Classification Search ..... 200/43.04, 200/51 R; 439/188, 199, 676, 519–521; 379/413.04, 397, 399, 412, 441–442
See application file for complete search history.

(56) References Cited

U.S. PATENT DOCUMENTS

| | | | | |
|---|---|---|---|---|
| 4,979,209 A | | 12/1990 | Collins et al. | |
| 5,297,199 A | | 3/1994 | Graham et al. | |
| 5,497,416 A | * | 3/1996 | Butler et al. | 379/413.04 |
| 5,671,273 A | * | 9/1997 | Lanquist | 379/413.04 |
| 5,704,797 A | | 1/1998 | Meyerhoefer et al. | |

* cited by examiner

*Primary Examiner*—K. Richard Lee
(74) *Attorney, Agent, or Firm*—Morgan & Finnegan LLP

(57) ABSTRACT

A modular device for a telephone network interface apparatus having separate connection and plug-actuated testing compartments. The compartment for connection having at least one pair of contact wires for connection to a subscriber premises line and at least one pair of contact wires for connection to an incoming telephone company line, and an arm member mounted for insertion in the connecting compartment and into engagement with the subscriber and telephone company contact wires effecting the connection between the pair of subscriber contact wires and the pair of telephone company contact wires and for being withdrawn from the connecting compartment causing the subscriber contact wires to be disconnected from the telephone company contact wires to provide a point for demarcation therebetween. The subscriber contact wires and telephone company contact wires are preferably oriented in a manner to facilitate their physical connection through the contact engagement of a nonconducting arm member inserted within the connecting department. The compartment for testing having at least one pair of telephone company contact wires for engagement with the plug of an operating telephone inserted into the testing compartment to facilitate the determination of whether a fault exists on the subscriber premises line or the incoming telephone company line. The telephone company contact wires within the testing compartment are preferably spaced apart and/or separated by insulating material in a manner to improve their dielectric strength.

12 Claims, 6 Drawing Sheets

MODULAR DEVICE HAVING SEPARATE CONNECTION AND PLUG-ACTUATED TESTING COMPARTMENTS

FIELD OF THE INVENTION

The apparatus according to the present invention relates to modular devices for testing fault origin of interrupted electrical service and for interconnecting provider wiring and subscriber wiring.

BACKGROUND OF THE INVENTION

The field of modular devices for testing fault origin and for interconnecting provider wiring and subscriber wiring has focused heretofore upon the connection of a single incoming telephone company ("telco") line to a single subscriber line. As a result, the structure of such devices does not address the need for the modular device to accommodate additional electrical lines. With increased availability of and demand for multiple subscriber services over electrical lines arises the need for a modular device that can accommodate multiple lines. The present invention discloses a novel and improved modular device which allows for the connection of multiple lines from a provider of electrically-based services to multiple subscriber lines, and for the fault-based testing of the wiring connections.

More particularly, the invention relates to a novel and improved modular device for a telephone network interface apparatus of the types illustrated in U.S. Pat. No. 5,704,797, entitled "Switchable Electrical Socket", issued on Jan. 6, 1998 to Carl H. Meyerhoefer et al. inventors, and assigned to the same assignee as the present invention; this patent is hereby incorporated herein by reference as if fully reproduced herein and this patent is referred to hereinafter as "the Meyerhoefer et al. patent". As disclosed in detail in the Meyerhoefer et al. patent, a modular device provides a point of demarcation between the telco wiring and the subscriber wiring so that a subscriber can determine whether a fault exists in the telco equipment or the subscriber premises, and has tool-less wire termination mechanisms for terminating and unterminating the telco and subscriber wiring. The novel and improved modular device of the present invention provides these same functions as well as additional functions, but does so with a patentably distinct structure and in a novel and improved manner.

As taught in detail by the Meyerhoefer et al. patent, the modular device has an RJ-11 telephone socket connected to the telco wiring. At the bottom of the socket, conductors of a heavier gauge than the RJ-11 electrical contact connect the subscriber wiring to the telco wiring. As illustrated by FIGS. 14-16 of the Meyerhoefer et. al patent, when the plug of an operating telephone used for default determination is inserted into the telephone socket, the plug pushes the subscriber and telco conductors into a disconnected orientation. FIG. 11, which illustrates the wiring schematic of the modular device, discloses the presence of the subscriber and telco wires necessary for a telephone connection within the RJ-11 telephone socket. Furthermore, as illustrated by FIGS. 17 and 18, the heavier gauge of the connecting subscriber and telco conductors result in a connecting mechanism substantially thicker than the width of the RJ-11 electrical contact. Thus, the RJ-11 telephone socket lacks the requisite area to accommodate more conductors than those necessary to complete a phone connection.

Another type of modular device is shown in U.S. Pat. No. 5,297,199 issued to Thomas G. Graham et al. on Mar. 22, 1994. The Graham et al. patent discloses a modular device having a telephone jack insert block connected to both the subscriber wiring and the incoming telco wiring. As illustrated in FIG. 6 of the Graham et al. patent, the subscriber wiring comprises two contacts within the telephone jack insert block and the telco wiring comprises two contacts within the telephone jack insert block. As further illustrated in FIG. 6, the four subscriber and telco contacts comprise all of contacts within the telephone jack insert block, with no space or allowance for additional contacts. As further illustrated in FIGS. 3, 5, and 9 of the Graham et al. patent, a pair of electrically conducting bridging members are affixed to the cover of the modular device. When the cover is in the closed orientation, the bridging members form a pair of series electrical connections between the telco and subscriber wiring. When the cover is opened, the series electrical connections are interrupted, leaving available the telephone socket for insertion of an RJ-11 telephone plug. Of the six grooves available in an RJ-11 plug for the placement of contact wires, the Graham et al. patent only utilizes two grooves for the purpose of fault determination of the telephone connection. The telephone jack insert block of the Graham et al. patent does not accommodate additional subscriber lines for connection to telco lines and the accompanying fault determination for additional lines.

Neither the Meyerhoefer et al. nor the Graham et al. patents disclose a modular device having separate connection and plug-actuated testing compartments, wherein the connection compartment can accommodate additional subscriber and telco lines and the separate testing compartment can accommodate additional associated telco contact wires for fault testing. The Meyerhoefer et al. and Graham et al. patents also do not disclose a connection mechanism whereby the subscriber contact wires and the telco contact wires are oriented in a manner to facilitate their physical connection through the engagement of a non-conducting arm member inserted within the connection compartment—thus, eliminating the cost, erosion and other disadvantages associated with an electrical conducting arm member.

Furthermore, neither the Meyerhoefer et al. nor the Graham et al. patents disclose telco contacts within a testing compartment spacially oriented and/or separated by insulating material in a manner to improve their dielectric strength. Indeed, because both the Meyerhoefer et al. and Graham et al. patents disclose a socket including both the subscriber wire and telco wire connection contacts as well as the telco wire testing contacts, the space within the socket is confined and cannot accommodate the advantages of additional subscriber/telco connection wires and the spacial separation required for improving the dielectric strength of the telco testing contacts.

SUMMARY OF THE INVENTION

The present invention overcomes the disadvantages of the prior art modular devices for testing and interconnecting wiring from a provider of electrical services ("provider") and subscriber wiring, as exemplified by the patents already discussed.

The present invention discloses a modular device with a novel mechanism for interconnecting wiring from a provider and subscriber wiring for single or multiple-line services such as electrical connections for, but not limited to, DSL, alarm systems, telephone lines, and low voltage power. In particular, in one embodiment, the invention relates to a modular device having an electrical contact block with a testing compartment, a contact wire insert, and a separate connection compartment. The contact wire insert contains one or multiple pairs of subscriber line contact wires and one or multiple pairs of bifurcated provider line contact wires. The connection compartment may contain a cavity and at least one pair of subscriber contact wires and at least one pair of provider contact wires. The connection compartment provides a point of demarcation between the provider wiring and the subscriber wiring and is separate from the testing compartment.

The connection between the provider wiring and the subscriber wiring within the connection compartment may be initiated by insertion of an arm member which may be secured to the modular device cover, and the connection may be terminated by withdrawal of the arm member from the compartment causing the subscriber wires to be disconnected from the provider wires. The testing compartment of the modular device may contain a cavity in the form of a plug-actuated socket capable of accepting an RJ-type plug and at least one pair of provider contact wires into which a functional testing device can be plugged to determine whether a fault exists in the provider equipment or the subscriber premises.

In another embodiment, the subscriber contact wires and provider contact wires are oriented in a manner, such as for example at a ninety (90) degree angle to each other, to effect contact therebetween upon engagement by a non-conducting arm member thereby connecting the subscriber contact wires and the provider contact wires within the connection compartment.

In still another embodiment, the pair of provider wires within the testing compartment are spaced, such as, for example, at a ten (10) degree angle relative to the axis between them, or alternatively an insulating member is disposed between the telco contact wires thereby increasing their dielectric strength.

It will be appreciated by those skilled in the art that the foregoing brief description and the following detailed description are exemplary and explanatory of this invention, but are not intended to be restrictive thereof or limiting of the advantages which can be achieved by this invention. Thus, the accompanying drawings, referred to herein and constituting a part hereof, illustrate preferred embodiments of this invention, and, together with the detailed description, serve to explain the principles of this invention.

BRIEF DESCRIPTION OF THE DRAWINGS

The features and advantages of the present invention, both as to its structure and operation, will be apparent from the following detailed description, especially when taken in conjunction with the accompanying drawings, wherein.

DETAILED DESCRIPTION OF THE INVENTION

Figure 1:
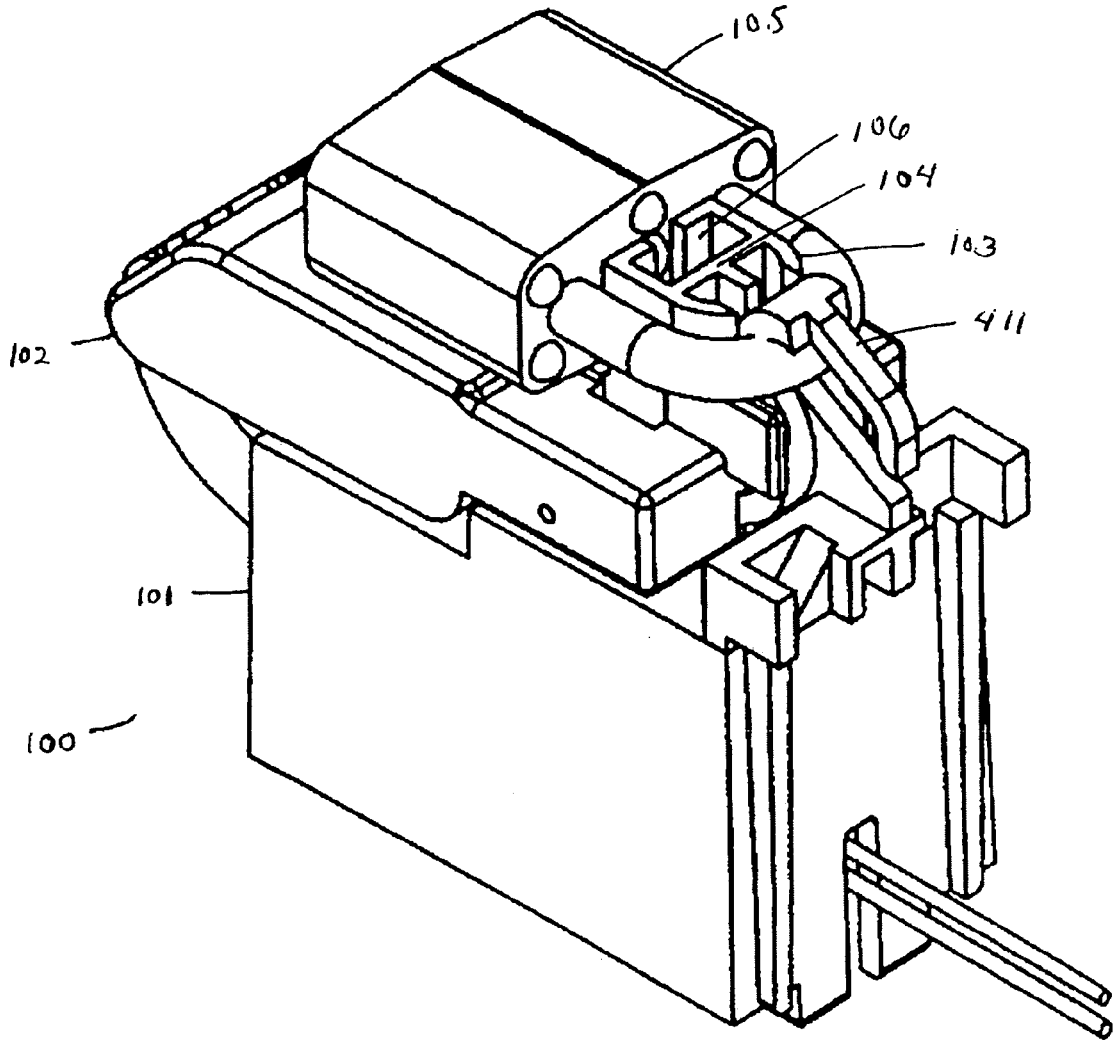
FIG. 1 is a perspective view taken from the line end of the modular device of the present invention.
Figure 2:
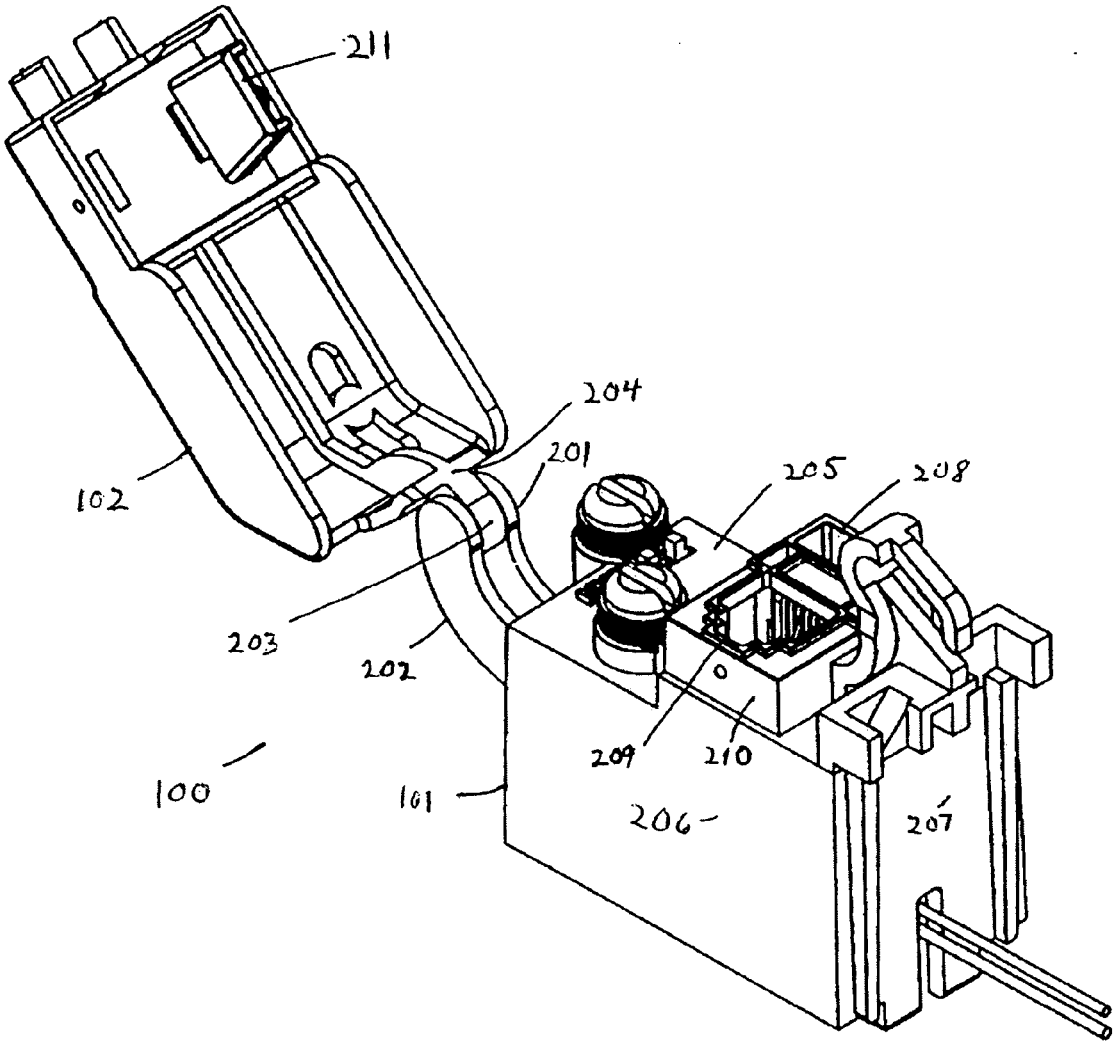
FIG. 2 is a perspective view showing the structural elements with the cover of the modular device of the present invention in the open position.

A modular device according to the principles of the present invention is illustrated in FIG. 1 and indicated by numerical designation 100. Modular device 100 includes housing 101 and cover 102. As shown in FIG. 2, upwardly curving hinge arms 201 and 202 protrude from housing 101 and attach to protruding circular clasp 203 which is fortified by cross-shaped support 204 and attached to cover 102. Modular device 100 serves as a junction for connecting conventional insulated provider and subscriber wiring for services provided by the provider and may be used to connect multiple service lines. It will be understood generally that modular device 100 is for testing fault origin and for interconnecting provider wiring and subscriber wiring, and it will be further understood that modular device 100 may connect a single set or multiple sets of provider and subscriber lines.

Referring again to FIG. 2, housing 101 of modular device 100 is a generally rectangular, hollow box-like structure, including top 205, opposed sides 206 and opposed ends 207. Of course, housing 101 may be of any shape, size or configuration suitable for use in the invention. With cover 102 in an open orientation, connecting compartment 208 and separate testing compartment 209 of electrical contact block 210 can be seen positioned on top 205 of modular device 100. Also visible in FIG. 2 is arm member 211 which is inserted within connecting compartment 208 when cover 102 is in the closed position.

Figure 3:
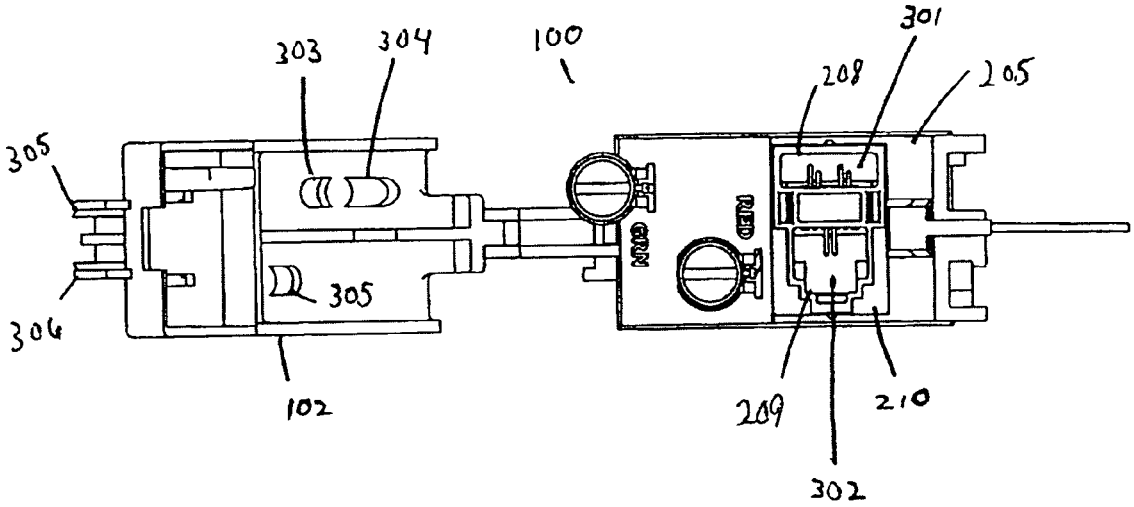
FIG. 3 is a top view showing the structural elements with the cover of the modular device of the present invention in the open position.

Referring now to FIG. 3, with cover 102 in an open orientation, connecting compartment 208 and testing compartment 209 of electrical contact block 210 can be seen from top 205 of modular device 100. Cavity 301 of connecting compartment 208 contains contact wires 501, 502, 503 and 504 (shown in FIG. 5), and cavity 302 of separate testing compartment 209 contains contact wires 505 and 506 (shown in FIG. 5). The positioning of contact wires 501, 502, 503 and 504 within cavity 301 of connecting compartment 208 and contact wires 505 and 506 within separate testing compartment 209 is best understood and illustrated when referring to FIG. 4.

Figure 4:
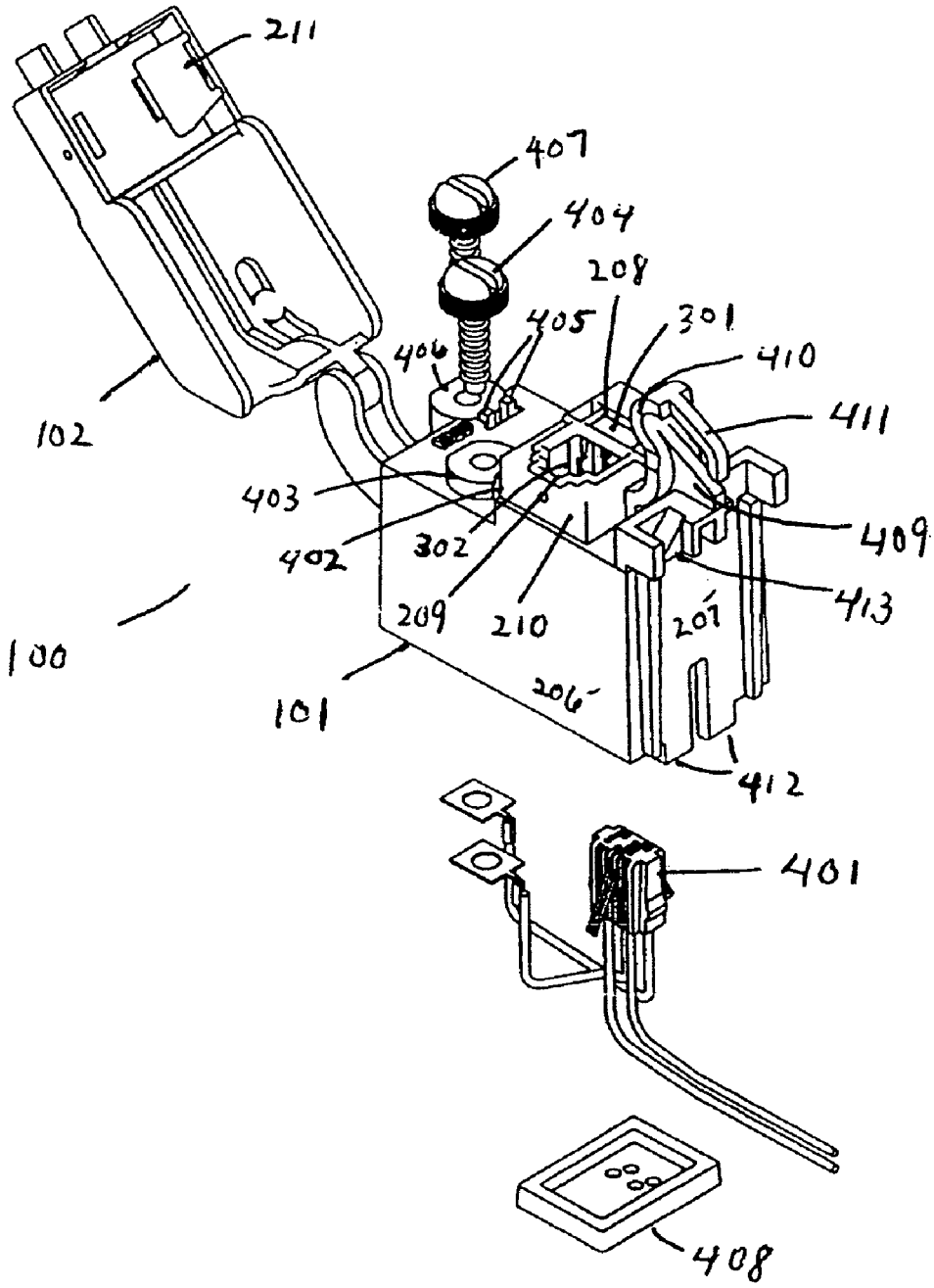
FIG. 4 is a partially exploded view taken from the line end showing in detail particular structural elements, including the contact wire insert, with the cover of the modular device of the present invention in the open position.

Referring now to FIG. 4, contact wire insert 401 inserts from the bottom of housing 101 into electrical contact block 210 to snap, preferably irreversibly, into a socket (not shown). Contact wire insert 401 is oriented within electrical contact block 210 such that contact wires 501, 502, 503 and 504 are positioned within cavity 301 of connecting compartment 208 and contact wires 505 and 506 are positioned within cavity 302 of separate testing compartment 209. A non-conducting protective strip may be affixed to contact wire insert 401 to prevent shock hazard from contact wires 501 to 506 upon rotation of cover 102 into the open orientation of modular device 100.

Figure 5:
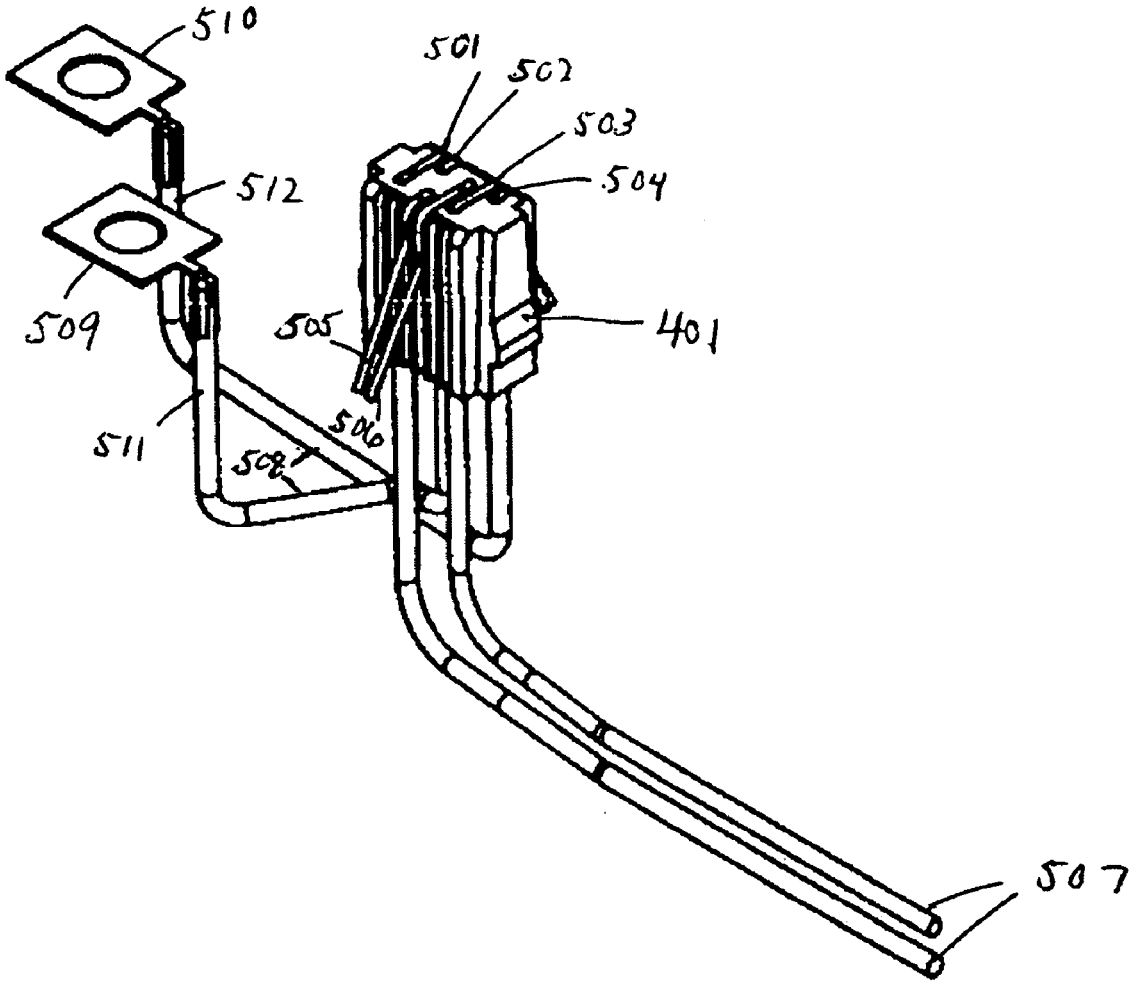
FIG. 5 is a perspective view taken from the line end of the contact wire insert of the present invention.

Referring now to FIG. 5, contact wire insert 401 contains contact wires 501, 502, 503 and 504 and contact wires 505 and 506 positioned on opposite sides of contact wire insert 401. Contact wires 501 and 505 are ring wires from the provider line. Contact wires 503 and 506 are tip wires from the provider line. Contact wire 502 is a ring wire from the subscriber line. Contact wire 504 is a tip wire from the subscriber line. Pair of wires 507 lead to the provider line and pair of wires 508 lead to terminals 509 and 510. Subscriber ring wire 511 meets terminal 509 and subscriber tip wire 512 meets terminal 510.

Upon closing cover 102, arm member 211 (FIGS. 2 and 4) is inserted within cavity 301 of connecting compartment 208 and arm member 211 connects contact wire 501 to contact wire 502 and contact wire 503 to contact wire 504. Connection of contacts 501 to 502 and 503 to 504 results in initiation of electrical service from provider to subscriber. A conducting arm member may be utilized to effect the connection between subscriber and telco wire contacts within the connecting compartment. However, in one embodiment, arm member 211 can be manufactured from a nonconducting material and the connection between subscriber and telco wire contacts is effected due to the relative orientation of the subscriber and telco wire contacts.

Figure 6:
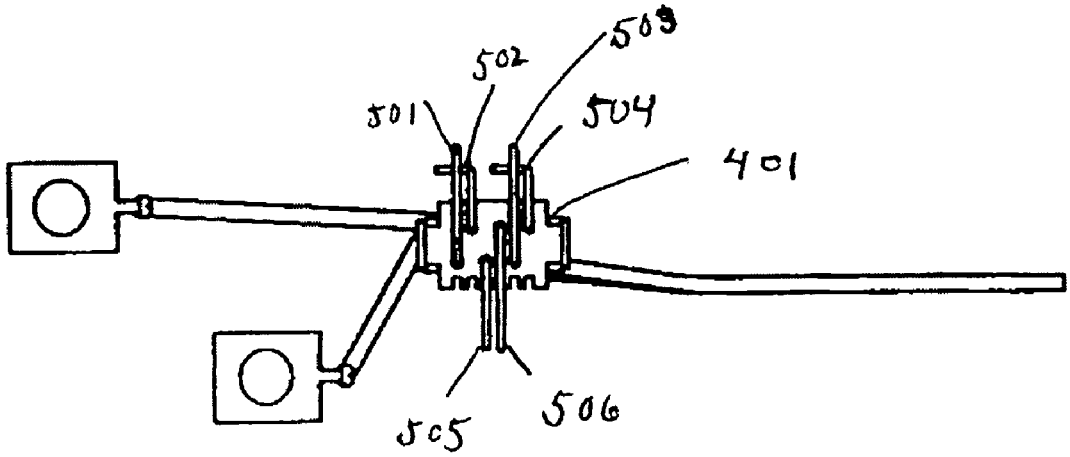
FIG. 6 is a top view of the contact wire insert of the present invention.

For example, as shown in FIG. 6, subscriber wire contacts 502 and 504 are oriented at a ninety (90) degree angle relative to telco wire contacts 501 and 503. When cover 102 is in the open position, the subscriber and telco wire contacts are not in physical contact with each other. However, when cover 102 is closed and arm member 211 is inserted into connecting component 208 and engages the subscriber and telco wire contacts, a connection is made between the subscriber and telco wire contacts because they are moved or pushed by the arm member so that they become physically in contact with each other. The subscriber and telco wire contacts may be oriented in any manner to effect a physical contact connection rather than a conducting connection in accordance with the invention.

Separation of connecting compartment 208 from testing compartment 209 allows isolation of testing contact wires 505 and 506 within cavity 302 of testing compartment 209, thereby permitting multiple additional contacts for fault testing. Fault testing occurs in the open orientation of modular device 100 (FIGS. 2-4) by inserting an operational plug, for example, an RJ-type plug such as an RJ-11 type plug, into cavity 302 of testing compartment 209. As shown in FIG. 6, isolation of testing contact wires 505 and 506, permits for greater flexibility and space to orient testing contact wires in a manner to increase their dielectric strength. For example, testing contact wires 505 and 506 may be spaced further apart, such as, for example at a ten (10) degree angle relative to the axis between them, or a nonconducting material may be placed between the testing contact wires to increase their dielectric strength.

Separation of connection compartment 208 from testing compartment 209 also permits for an increased number of provider/subscriber connections and corresponding testing contact wires. For example, in another embodiment of electrical contact block 210, a larger contact wire insert 401 than shown in FIGS. 4-6 may be used to allow additional provider and subscriber contact wires to be inserted. Testing compartment 209 and connecting compartment 208 may be correspondingly enlarged to allow insertion of an enlarged RJ-testing plug into compartment 302 and enlarged arm member 211 into connecting compartment 208. Separation of the connection and testing compartments still further allows for greater flexibility in positioning the compartments on the electrical contact block and the housing.

Referring now to FIGS. 4 and 5, subscriber ring wire 511 extends through upwardly protruding contact guides 402 to end in ring terminal 509. Terminal 509 rests upon protruding screw cylinder 403 and is fixedly attached by screw terminal 404. A ring wire for subscriber line (not shown) ends in a contact which attaches to screw terminal 404. Subscriber tip wire 512 extends through upwardly protruding contact guides 405 to end in tip terminal 510. Terminal 510 rests upon protruding screw cylinder 406 and is fixedly attached by screw terminal 407. A tip wire for subscriber line (not shown) ends in a contact which attaches to tip terminal 510. Conductor wires, contact guides, terminals and screw cylinders may be introduced as necessary to modular device 100 to accommodate additional provider services.

Holes 303 and 304 (FIG. 3) in cover 102 may accept an electrical test clip for attachment to screw terminal 407 in the closed orientation of modular device 100 for the purpose of checking tip wire connection. Hole 305 (FIG. 3) and an additional hole not shown in cover 102 may accept an electrical test clip for attachment to screw terminal 404 in the closed orientation of modular device 100 for the purpose of checking ring wire connection. Cover 102 may have additional holes as necessary to accommodate the addition of subscriber lines to modular device 100.

Modular device 100 may also include a security mechanism to prevent the device from being opened by a non-subscriber. As shown in FIG. 4, fixedly attached to top of end 408 of housing 101 is triangular support base 409 having a plane of triangular shape parallel to the plane of side 206. Base 409 supports S-shaped ascending arm 410 of locking clasp 411. On top of cover 102 as shown in FIG. 1 is an upwardly protruding stabilizer 103. Stabilizer 103 contains stabilizer cross-support 104 and outwardly protruding guides 305 and 306 (FIG. 2). When modular device 100 is in closed orientation (FIG. 1), guides 305 and 306 flank S-shaped ascending arm 410. As shown in FIG. 1, a padlock 105 hooks through locking clasp 411 to lock modular device 100 and padlock shackle 106 fits around stabilizer cross-support 104 of stabilizer 103 to immobilize padlock 105.

Modular device 100 may also be connected to a telephone network interface apparatus. As shown in FIG. 4, end 408 contains such structural features as downwardly protruding guides 412 and wedge-shaped guide 413 to assist in mounting modular device 100 into a telephone network interface apparatus as shown in FIGS. 1 and 2 of the Meyerhoefer et al. patent.

Although illustrative preferred embodiments have been described herein in detail, it should be noted and will be appreciated by those skilled in the art that numerous variations may be made within the scope of this invention without departing from the principles of this invention and without sacrificing its chief advantages. The terms and expressions have been used as terms of description and not terms of limitation. There is no intention to use the terms or expressions to exclude any equivalents of features shown and described or portions thereof and this invention should be defined in accordance with the claims which follow.

The invention claimed is:

1. A modular device for mounting to a telephone network interface apparatus, comprising:

a first compartment adapted for receiving a plug and containing at least one pair of first contact wires adapted to be connected to a telephone company line;

a second compartment containing at least one pair of second contact wires adapted to be connected to a subscriber line and at least one pair of third contact wires adapted to be connected to a telephone company line; and an arm member adapted to be inserted within said second compartment and into direct engagement with said at least one pair of second and third contact wires, when said arm member is inserted into said second compartment and into direct engagement with said at least one pair of second and third contact wires, each contact wire of said at least one pair of second contact wires connects with a respective contact wire of said at least one pair of third contact wires for connecting the subscriber line to the telephone company line.

2. The device according to claim 1, wherein said arm member is nonconductive.

3. The device according to claim 2, wherein said nonconductive arm member connects said each contact wire of said at least one pair of second contact wires with said respective contact wire of said at least one third pair of contact wires by pushing said at least one pair of second and third contact wires together.

4. The device according to claim 3, wherein said at least one pair of second contact wires are oriented at a ninety (90) degree angle to said at least one pair of third contact wires.

5. The device according to claim 1, wherein said at least one pair of second and third contact wires are spacially oriented to increase their dielectric strength.

6. The device according to claim 5, wherein said at least one pair of second and third contact wires are spaced apart by a ten (10) degree angle relative to an axis there between.

7. The device according to claim 1, wherein a nonconductive material is disposed between said at least one pair of second and third contact wires.

8. The device according to claim 1, wherein said first compartment is adapted to receive an RJ-type plug.

9. The device according to claim 8, wherein said RJ-type plug is an RJ-11 plug.

10. The device according to claim 1, wherein said arm member is attached to a cover and is inserted within said second compartment when said cover is in a closed position and withdrawn from said second compartment when said cover is an open position.

11. The device according to claim 10, further comprising at least one screw terminal and at least one hole in said cover for testing the connection of said each contact wire of said at least one pair of second contact wires with said respective contact wire of said at least one pair of third contact wires in said closed position.

12. The device according to claim 10, further comprising a mechanism for locking said device in said closed position.

* * * * *